US010443012B2

(12) United States Patent
Zhang et al.

(10) Patent No.: US 10,443,012 B2
(45) Date of Patent: Oct. 15, 2019

(54) LUBRICATING OIL COMPOSITION

(71) Applicant: The Lubrizol Corporation, Wickliffe, OH (US)

(72) Inventors: Yanshi Zhang, Solon, OH (US); Mark J. McGuiness, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 3 days.

(21) Appl. No.: 15/523,718

(22) PCT Filed: Oct. 16, 2015

(86) PCT No.: PCT/US2015/055933

§ 371 (c)(1),
(2) Date: May 2, 2017

(87) PCT Pub. No.: WO2016/081111

PCT Pub. Date: May 26, 2016

(65) Prior Publication Data

US 2017/0335227 A1 Nov. 23, 2017

Related U.S. Application Data

(60) Provisional application No. 62/082,651, filed on Nov. 21, 2014.

(51) Int. Cl.
*C10M 163/00* (2006.01)
*C10M 139/00* (2006.01)

(52) U.S. Cl.
CPC .. *C10M 139/00* (2013.01); *C10M 2203/1025* (2013.01); *C10M 2215/28* (2013.01); *C10M 2219/046* (2013.01); *C10M 2219/089* (2013.01); *C10M 2223/045* (2013.01); *C10M 2227/061* (2013.01); *C10M 2227/062* (2013.01); *C10N 2230/12* (2013.01); *C10N 2230/42* (2013.01); *C10N 2230/44* (2013.01); *C10N 2240/02* (2013.01); *C10N 2240/10* (2013.01)

(58) Field of Classification Search
CPC ..... C10M 2201/087; C10M 155/04
USPC ..... 508/186
See application file for complete search history.

(56) References Cited

U.S. PATENT DOCUMENTS 6,004,910 A * 12/1999 Bloch ..... C10M 163/00 508/294

FOREIGN PATENT DOCUMENTS

WO WO-2012162020 A1 * 11/2012 ..... C10L 1/2222

* cited by examiner

*Primary Examiner* — Prem C Singh
*Assistant Examiner* — Francis C Campanell
(74) *Attorney, Agent, or Firm* — Michael A. Miller; Eryn A. Fuhrer

(57) ABSTRACT

The invention provides a lubricant composition containing an oil of lubricating viscosity and a boron-containing compound, wherein the boron containing compound comprises a borate ester comprising at least one alkyl group having a branch at the ? position or higher. The invention further relates to a method of lubricating an internal combustion engine with the lubricant composition.

7 Claims, No Drawings

LUBRICATING OIL COMPOSITION

CROSS REFERENCE TO RELATED APPLICATION

This application claims priority from PCT Application Serial No. PCT/US2015/055933 filed on Oct. 16, 2015, which claims the benefit of U.S. Provisional Application No. 62/082,651 filed on Nov. 21, 2014, the entirety of both of which is hereby incorporated by reference.

FIELD OF INVENTION

The invention provides a lubricating composition containing an oil of lubricating viscosity and a boron containing compound, which may comprise a borate ester comprising at least one alkyl group having a branch at the β or higher position. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from wear, soot deposits and acid build up. Often, such surface active additives including zinc dialkyldithiophosphates (common antiwear additive for engine lubricating oils is zinc dialkyldithiophosphate (ZDDP)) or dispersants can have harmful effects on bearing corrosion or friction performance.

Many of these additive chemistries are corrosive to lead or copper. It is difficult for formulators to meet the present engine oil specifications by employing certain beneficial additives while also meeting the specification for lead or copper corrosion. With the introduction of industry specifications and legislation to reduce emissions, there are tighter limits on ash-containing, sulfur-containing and phosphorus-containing components. For example, industry specifications such as API CJ-4, as well as MACK T-11 and Mack T-12 tests, have been introduced for heavy duty diesel engines.

There has been a commercial trend for reduction in emissions (typically reduction of NOx formation, SOx formation) and a reduction in sulfated ash in engine oil lubricants. Consequently, the amounts of phosphorus-containing antiwear agents such as ZDDP, overbased detergents such as calcium or magnesium sulfonates and phenates have been reduced. As a consequence, ashless additives have been contemplated to provide friction or antiwear performance. It is known that surface active ashless compounds such as ashless dispersants may in some instances increase corrosion of metal, namely, copper or lead. Copper and lead corrosion may be from bearings and other metal engine components derived from alloys using copper or lead. Consequently, there is a need to reduce the amount of corrosion caused by ashless additives.

SUMMARY OF THE INVENTION

The invention is directed to a lubricant composition that is capable of providing at least one of antiwear performance, friction modification (particularly for enhancing fuel economy), extreme pressure performance, antioxidant performance, lead and copper corrosion inhibition, or seal swell performance. In one embodiment the invention is directed to a lubricant composition that is capable of providing at least one of lead or copper corrosion inhibition. As used herein reference to the amounts of additives present in the lubricant composition disclosed herein are quoted on an oil free basis, i.e., amount of actives.

In one embodiment, the invention provides a lubricant composition comprising an oil of lubricating viscosity and boron containing compound.

In one embodiment, the invention provides a lubricant composition comprising an oil of lubricating viscosity and a boron containing compound, wherein the boron containing compound comprises a borate ester.

In one embodiment, the invention provides a lubricant composition comprising an oil of lubricating viscosity and a boron containing compound, wherein the boron containing compound comprises a borate ester, wherein the borate ester comprises at least one alkyl group having a branch at the β position or higher.

In one embodiment, the invention provides a lubricant composition comprising an oil of lubricating viscosity and a borate ester comprising at least one alkyl group having about 10 to about 32 carbon atoms, wherein the alkyl group has a branch at the β position or higher.

In one embodiment, the invention provides a lubricant composition comprising an oil of lubricating viscosity and a borate ester comprising at least one alkyl group having about 10 to about 32 carbon atoms, the alkyl group having a branch at the β or higher position, wherein the alkyl group has a structure represented by $—CH_2—C(R^1)(R^2)$, where $R^1$ is an alkyl group of about 7 to about 18 carbon atoms and $R^2$ is an alkyl group having fewer carbon atoms than $R^1$.

In one embodiment, the invention provides a lubricant composition comprising an oil of lubricating viscosity and a borate ester comprising at least one alkyl group having about 10 to about 32 carbon atoms, said alkyl group having a branch at the β or higher position, wherein the alkyl group is derived from a Guerbet alcohol.

The invention also provides a method for lubricating a mechanical device. Such method comprises supplying to a mechanical device a lubricant composition comprising an oil of lubricating viscosity and a boron containing compound, wherein the boron containing compound comprises a borate ester, wherein the borate ester comprises at least one alkyl group having a branch at the β position or higher.

DETAILED DESCRIPTION OF THE INVENTION

The invention described herein provides a lubricant composition which comprises an oil of lubricating viscosity and a boron containing compound and a method for lubricating an engine using such lubricant composition.

The Boron-Containing Compound

In one embodiment the lubricating composition of the invention includes a boron-containing compound. In one embodiment, the boron-containing compound includes a borate ester or a borated alcohol.

Borate esters may be prepared by the reaction of a boron compound and at least one compound selected from epoxy compounds, halohydrin compounds, epihalohydrin compounds, alcohols and mixtures thereof In one useful embodiment, the borate ester is a compound represented by one or more of the following formulas $(RO)_3B$, $(RO)_2B—O—B(OR)_2$, or

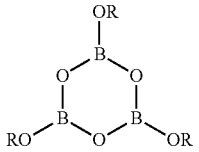

wherein each R is independently an organic group and any two adjacent R groups may together form a cyclic group. Mixtures of two or more of the foregoing may be used. In one embodiment, R is a hydrocarbyl group. The total number of carbon atoms in the R groups in each formula must be sufficient to render the compound soluble in the base oil. Generally, the total number of carbon atoms in the R groups is at least about 10, and in one embodiment at least about 12. There is no limit to the total number of carbon atoms in the R groups. However, in some embodiments, the R groups may contain for example, 10 to 100 carbon atoms, further for example, 12 to 100 carbon atoms, even further for example, 10 to 50 carbon atoms, further for example, 12 to 50 carbon atoms, even further for example 10 to 32 carbon atoms, even further for example 12-32 carbon atoms. Each R group may be the same as the other, although they may be different.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment, useful R groups include branched alkyl groups. Borate esters containing branched R groups may be formed from the reaction of a boron containing compound, such as a boric acid with a branched alcohol. Suitable branched alcohols may include any branched alcohols containing at least 10, or at least 12, carbon atoms and wherein the alcohol is branched at the 0 position or higher. Suitable alcohols may be selected from Guerbet alcohols which have substitution on the second carbon from the hydroxyl group, with the proviso that the Guerbet alcohol has at least about 10, or at least about 12 carbon atoms, for example, about 10 to about 32 carbon atoms or about 12 to about 32 carbon atoms. Useful branched alcohols may also include 2-propylheptanol, 2-butyloctanol, 2-hexyldecanol, 2-octyldodecanol, and isotridecanol. Additional useful branched alcohols include mixtures of branched isoalcohols having from 11-15 carbon atoms, for example $C_{11}$, $C_{12}$, $C_{13}$, $C_{14}$, $C_{15}$, and mixtures thereof. Commercial examples of useful alcohols include Exxal®13 alcohol produced by Exxon-Mobile Chemical Co., which is a highly branched mixture of $C_{11}$, $C_{13}$, and $C_{14}$ isoalcohols; Marlipal® O13 alcohol produced by Sasol, which is a branched $C_{13}$ alcohol mixture based on hydroformylation of butane trimers; ISALCHEM® alcohols, also produced by Sasol, which are primary isomeric alcohols with alkyl chain distributions of 11 to 15 carbon atoms such as ISALCHEM® 123 A, which is an isomeric mixture of alcohols having 12 and 13 carbon atoms and ISALCHEM® 145 A, which is an isomeric mixture of alcohols having 14 and 15 carbon atoms; and SAFOL® 23 alcohol produced by Sasol, which is a mixture of branched and linear alcohols, where the branching on the branched alcohol is predominately higher than the β position, and which is produced by the hydroformylation of olefins obtained via a FischerTropsch process.

Borate esters useful in the present invention may contain one or more branched alkyl groups, which have a structure represented by $—CH_2.C(R^1)(R^2)$ wherein $R^1$ is an alkyl group of about 7 to about 18 carbon atoms and $R^2$ is an alkyl group having fewer carbon atoms that $R^1$. In one embodiment $R^2$ has two fewer carbon atoms than $R^1$. It should be understood that $R^1$ and $R^2$ can have any number of carbon atoms with the proviso that the branched alkyl group has at least 10, for example, at least 12 carbon atoms total. Useful alkyl groups include 2-propylheptyl, 2-butyloctyl, 2-hexyldecyl, 2-octyldodecyl, tridecyl, 2-decyl tetradecyl, 2-dodecyl hexadecyl, 2-tetradecyl octadecyl, 2-hexadecyl eicosanyl, and combinations and mixtures of the foregoing.

In one useful embodiment, the boron containing compound comprises a borate ester represented by the structure

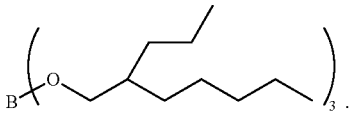

The boron-containing compound may be employed in the inventive lubricating oil composition at a sufficient concentration to provide the lubricating oil composition with a boron level in the range of from 5 ppm to 2000 ppm, and in one embodiment 15 ppm to 600 ppm, and in one embodiment 20 ppm to 300 ppm, and in one embodiment 100 ppm to 200 ppm.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives may include at least one of metal deactivators, viscosity modifiers, detergents, friction modifiers, antiwear agents, corrosion inhibitors (other than the boron containing compound of the present invention), dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent, a dispersant viscosity modifier, a friction modifier, a corrosion inhibitor, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenep entamine, pentaethylene-hexamine, polyamine still bottoms, and mixtures thereof.

The dispersant may also be derived from a material having an aromatic amine. The aromatic amine that may be useful is disclosed in International publications WO2010/062842 and WO2009/064685 (a similar disclosure is provided in US 2010/298185). The aromatic amine of WO2009/064685 is typically reacted with isatoic anhydride.

The aromatic amine may typically not be a heterocycle. The aromatic amine may include aniline, nitroaniline, aminocarbazole, 4-aminodiphenylamine (ADPA), and coupling products of ADPA. In one embodiment the amine may be 4-aminodiphenylamine (ADPA), or coupling products of ADPA. The aromatic amine may include bis[p-(p-amino-anilino)phenyl]-methane, 2-(7-amino-acridin-2-ylmethyl)-N-4-{4-[4-(4-amino-phenylamino)-benzyl]-phenyl}-benzene-1,4-diamine, N-{4-[4-(4-amino-phenylamino)-benzyl]-phenyl}-2-[4-(4-amino-phenyl amino)-cyclohexa-1,5-dienylmethyl]-benzene-1,4-diamine, N-[4-(7-amino-acridin-2-ylmethyl)-phenyl]-benzene-1,4-diamine, or mixtures thereof.

The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521; dispersants made in this manner are often derived from high vinylidene (i.e. greater than 50% terminal vinylidene) polyisobutylene (See col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Dispersants may be derived from, as the polyolefin, high vinylidene polyisobutylene, that is, having greater than 50, 70, or 75% terminal vinylidene groups ($\alpha$ and $\beta$ isomers). In certain embodiments, the succinimide dispersant may be prepared by the direct alkylation route. In other embodiments it may comprise a mixture of direct alkylation and chlorine-route dispersants.

The dispersant may also exhibit basicity, as measured by Total Base Number (TBN). TBN may be determined by ASTM D2896. This will particularly be the case if the dispersant is prepared with an amine, such as a polyamine, and the amine contains one or more amino groups that have not reacted with acidic groups of the dispersant. In some embodiments, the TBN of the dispersant may be 1 to 110 mg KOH/g, or 5 to 50 mg KOH/g, or 10 to 40 mg KOH/g or 30 to 70 mg KOH/g on an oil-free basis. In some embodiments, however, the dispersant may not exhibit basicity (that is, have a TBN of 0 or nearly 0). In one embodiment the dispersant has a TBN of zero as measured by D2896. Such could be the case if no basic nitrogen is present on the dispersant. In some embodiments, the lubricating composition comprises at least one basic amine-functionalized dispersant in an amount to deliver TBN at 0.5 to 8 mg KOH/g, or 0.75 to 4 mg KOH/g, or 1.2 to 2.3 mg KOH/g to the lubricating composition.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be present at 0.1 wt % to 10 wt %, or 2.5 wt % to 6 wt %, or 3 wt % to 5 wt % of the lubricating composition.

In one embodiment the lubricating composition of the invention further comprises a dispersant viscosity modifier.

The dispersant viscosity modifier may be present at 0 wt % to 5 wt %, or 0 wt % to 4 wt %, or 0.05 wt % to 2 wt % of the lubricating composition.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the dispersant viscosity modifier may include those described in U.S. Pat. No. 7,790,661 column 2, line 48 to column 10, line 38. The dispersant viscosity modifier of U.S. Pat. No. 7,790,661 includes (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) amines comprising two aromatic moieties linked by a —C(O)NR— group, a —C(O)O— group, an —O— group, an —N—N— group, or an —$SO_2$— group, wherein R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine.

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition. In certain embodiments the phosphorus antiwear agent may be present in an amount to deliver 0.01 to 0.2 or 0.015 to 0.15 or 0.02 to 0.1 or 0.025 to 0.08 percent phosphorus to the lubricating composition.

Zinc dialkyldithiophosphates may be described as primary zinc dialkyldithio-phosphates or as secondary zinc dialkyldithiophosphates, depending on the structure of the alcohol used in its preparation. In some embodiments the compositions of the invention include primary zinc dialkyldithiophosphates. In some embodiments the compositions of the invention include secondary zinc dialkyldithiophosphates. In some embodiments the compositions of the invention include a mixture of primary and secondary zinc dialkyldithiophosphates. In some embodiments component (b) is a mixture of primary and secondary zinc dialkyldithiophosphates where the ratio of primary zinc dialkyldithiophosphates to secondary zinc dialkyldithiophosphates (one a weight basis) is at least 1:1, or even at least 1:1.2, or even at least 1:1.5 or 1:2, or 1:10. In some embodiments component (b) is a mixture of primary and secondary zinc dialkyldithiophosphates that is at least 50 percent by weight primary, or even at least 60, 70, 80, or even 90 percent by weight primary. In some embodiments component (b) is free of primary zinc dialkyl-dithiophosphates.

In one embodiment the invention provides a lubricating composition further comprising a molybdenum compound. The molybdenum compound may be selected from the group consisting of molybdenum dialkyldithiophosphates, molybdenum dithio-carbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulfur containing phenates, sulfur containing phenates, sulfonates, salixarates, salicylates, and mixtures thereof The overbased detergent may also include "hybrid" detergents formed with mixed surfactant systems including phenate and/or sulfonate components, e. g. , phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Typically an overbased detergent may be sodium, calcium or magnesium salt of the phenates, sulfur containing phenates, sulfonates, salixarates and salicylates. Overbased phenates and salicylates typically have a total base number of 180 to 450 TBN. Overbased sulfonates typically have a total base number of 250 to 600, or 300 to 500. Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulfonate detergent may be particularly useful for assisting in improving fuel economy.

In one embodiment, a sulfonate detergent may be a branched alkylbenzene sulfonate detergent. Branched alkylbenzene sulfonate may be prepared from isomerized alpha olefins, oligomers of low molecular weight olefins, or combinations thereof. Suitable oligomers include tetramers, pentamers, and hexamers of propylene and/or butylene. In other embodiments, an alkylbenzene sulfonate detergent may be derived from a toluene alkylate, i.e, the alkylbenzene sulfonate may have at least two alkyl groups, at least one of which is a methyl group, the other being a linear or branched alkyl group as described above. Oil-soluble alkyl toluene sulfonate compounds as disclosed in paragraphs [0046] to [0053] of US Patent Application 2008/0119378.

Phenate detergents are typically derived from p-hydrocarbyl phenols or, generally, alkylpheols. Alkylphenols of this type may be coupled with sulfur and overbased, coupled with aldehyde and overbased, or carboxylated to form salicylate detergents. Suitable alkylphenols or alkylsalicylates include those alkylated with oligomers of propylene, i.e. tetrapropenylphenol (i.e. p-dodecylphenol or PDDP) and pentapropenylphenol. Suitable alkylphenols or alkylsalicylates also include those alkylated with oligomers of butene, especially tetramers and pentamers of n-butenes. Other suitable alkylphenols or alkylsalicylate include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent or salicylate detergent derived from PDDP. In one embodiment, the lubricant composition comprises a phenate detergent or salicylate detergent that is not derived from PDDP. In one embodiment, the lubricating composition comprises a phenate detergent or salicylate detergent prepared from PDDP, such detergent contains less than 1.0 weight percent unreacted PDDP, or less than 0.5 weight percent unreacted PDDP, or is substantially free of PDDP.

The overbased detergent may be present at 0 wt % to 15 wt %, or 1 wt % to 10 wt %, or 3 wt % to 8 wt %. For example in a heavy duty diesel engine the detergent may be present at or 3 wt % to 5 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulfurized olefins, alkylated diphenylamines (typically dinonyl diphenylamine, octyl diphenylamine, dioctyl diphenylamine), phenyl-α-naphthylamine (PANA), hindered phenols, molybdenum compounds (such as molybdenum dithiocarbamates), or mixtures thereof The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl esters, amides, or imides of tartaric acid; fatty alkyl esters, amides, or imides of malic acid; fatty alkyl esters or amides of citric acid; fatty alkyl esters or amides of glycolic or poly(glycolic) acid; fatty alkyl esters of furanoic acid; fatty alkyl esters of tetrahydrofuran-2-carboxylic acid; and combinations thereof. The friction modifier may be present at 0 wt % to 6 wt %, or 0.05 wt % to 4 wt %, or 0.1 wt % to 2 wt % of the lubricating composition. In one embodiment the lubricating composition may be free of long chain fatty esters (typically glycerol monooleate).

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with the branch in the one or two position.

In one embodiment the friction modifier may be selected from the group consisting of long chain fatty acid derivatives of amines, fatty esters, or fatty epoxides; fatty alkyl citrates, fatty alkyl tartrates; fatty alkyl tartrimides; and fatty alkyl tartramides.

In one embodiment the friction modifier may be a long chain fatty acid ester. In another embodiment the long chain fatty acid ester may be a mono-ester and in another embodiment the long chain fatty acid ester may be a triglyceride.

Other performance additives such as corrosion inhibitors include those described in paragraphs 5 to 8 of WO2006/047486, octyl octanamide, condensation products of dodecenyl succinic acid or anhydride and a fatty acid such as oleic acid with a polyamine. In one embodiment the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles.

Foam inhibitors include polysiloxane or copolymers of ethyl acrylate and 2-ethylhexyl acrylate and optionally vinyl acetate.

Demulsifiers include trialkyl phosphates, polyethylene glycols, polyethylene oxides, polypropylene oxides and (ethylene oxide-propylene oxide) polymers.

Pour point depressants include esters of maleic anhydride-styrene, polymethacrylates, polyacrylates or polyacrylamides.

Demulsifiers include trialkyl phosphates, polyethylene glycols, polyethylene oxides, polypropylene oxides and (ethylene oxide-propylene oxide) polymers.

Pour point depressants that may be useful in the compositions of the invention include poly(alpha-olefins), esters of maleic anhydride-styrene, poly(meth)acrylates, polyacrylates or polyacrylamides.

Industrial Application

The lubricating composition may be utilized in an internal combustion engine. The engine components may have a surface of steel or aluminum (typically a surface of steel).

An aluminum surface may be derived from an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas

Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less. The lubricating composition may be characterized as having (i) a sulfur content of 0.5 wt % or less, (ii) a phosphorus content of 0.1 wt % or less, and (iii) a sulfated ash content of 0.5 wt % to 1.5 wt % or less.

In one embodiment the lubricating composition may be characterized as having a sulfated ash content of 0.5 wt % to 1.2 wt %.

The following examples provide illustrations of the invention. These examples are non-exhaustive and are not intended to limit the scope of the invention.

To a 500-mL, 3-neck round-bottomed flask equipped with an overhead mechanical stirrer, Dean Stark strap, Friedrich's condenser, thermocouple, and a vapor-space nitrogen purge past the Dean Stark trap and condenser, boric acid and the corresponding alcohols are charged. Vapor-space nitrogen purge is set to 0.5 scfh. The slurry is slowly heated to 180° C. over a period of about 7 hours. Water is collected in the Dean Stark trap. The solid boric acid dissolves during the course of the reaction, giving a clear liquid. The product is filtered through filter paper with FAX 5 to remove a small amount of trace haze. The product was a clear, colorless liquid.

ADD1: Reaction product of 1 eq. of boric acid and 3 eq. of n-butanol.

ADD2: Reaction product of 1 eq. of boric acid and 3 eq. of n-octanol.

ADD3: Reaction product of 1 eq. of boric acid and 3 eq. of n-decanol.

ADD4: Reaction product of 1 eq. of boric acid and 3 eq. of n-dodecanol.

ADD5: Reaction product of 1 eq. of boric acid and 3 eq. of 2-ethyl hexanol.

ADD6: Reaction product of 1 eq. of boric acid and 3 eq. of 2-propyl heptanol.

ADD7: Reaction product of 1 eq. of boric acid and 2 eq. of 2-propyl heptanol.

ADD8: Reaction product of 1 eq. of boric acid and 3 eq. of 2-butyl octanol.

ADDS: Reaction product of 1 eq. of boric acid and 3 eq. of mixture of C12-13 branched alcohols (available from Sasol under the name Safol® 23 alcohol).

ADD10: Reaction product of 1 eq. of boric acid and 3 eq. of branched C13 alcohol (available from Sasol under the name Marlipal® O13 alcohol).

Compatibility Testing: The aforementioned borate esters were added to a base oil at 5% to make a series of diluted samples (see table below). Measured amount of diluted samples (20 g in mineral oil) were charged on to petri dishes. The samples were observed for the formation of insoluble material on top of the oil. The time for the formation of insoluble material is recorded. Longer time indicate better stability of the material in base oil.

TABLE 1

Stability Testing Results:

| Borate Ester | Time until solid formation (minutes) |
|---|---|
| ADD1 | 10 |
| ADD2 | 25 |
| ADD3 | 53 |
| ADD4* | Solid drop out |
| ADD5 | 45 |
| ADD6 | 55 |
| ADD8 | 130 |
| ADD9 | 85 |
| ADD10 | 85 |

*semi-solid, limited oil solubility

Results indicate that borate esters with longer alkyl groups provide better compatibility than those with shorter alkyl groups, whether the samples are linear or branched. Borate esters from long chain linear alcohol of C12 and above are semi-solid which poses compatibility issues. Borate esters with branched alkyl groups have improved compatibility/stability compared with borate esters containing linear alcohols of the same carbon count.

Lubricant Examples 1 (EX1) to 9 (EX9)

A series of 15W-40 engine lubricants in Group II base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives. All of the lubricants were prepared from a common formulation as follows in Table 2.

TABLE 2

Lubricating Oil Composition Base Formulation 1

| | Baseline |
|---|---|
| Group II Base Oil | Balance to 100% |
| Calcium overbased detergent[2] | 1.73 |
| Zinc dialkyldithiophosphate | 1.09 |
| Antioxidant | 1.23 |
| Active Dispersant[3] | 4.76 |
| Viscosity Modifier | 0.56 |
| Additional additives[4] | 1.16 |
| % Phosphorus | 0.11 |

[1]All concentrations are on an oil free (i.e. active basis)

[2]Combination alkylsulfonate and sulfur-coupled alkylphenol

[3]2200 Mn PIBsuccinimide dispersant (TBN ~55)

[4]Additional additives include friction modifiers, foam inhibitors, Surfactant, and soot DVM booster The additives of the invention were added to the baseline oil above as summarized in Table 3.

TABLE 3

Lubricating Oil Composition Formulations

| | ADD2 | ADD3 | ADD5 | ADD6 | ADD8 | ADD9 | B ppm |
|---|---|---|---|---|---|---|---|
| EX1 | | | | | | | 0 |
| EX2 | 0.37 | | | | | | 100 |

TABLE 3-continued

| Lubricating Oil Composition Formulations | | | | | | | |
|---|---|---|---|---|---|---|---|
| | ADD2 | ADD3 | ADD5 | ADD6 | ADD8 | ADD9 | B ppm |
| EX3 | | 0.45 | | | | | 100 |
| EX4 | | | 0.37 | | | | 100 |
| EX5 | | | | 0.44 | | | 100 |
| EX6 | | | | | 0.52 | | 100 |
| EX7 | | | | | | 0.55 | 100 |
| EX8 | | | 0.74 | | | | 200 |
| Ex9 | | | | 0.88 | | | 200 |

The lubricants described above are evaluated in copper and lead bench corrosion tests according to an extended ASTM D6594 High Temperature Corrosion Bench Test (HTCBT) protocol (Test run 336 hr instead of 168 hr). The amount of lead (Pb) and copper (Cu) in the oils at the end of test is measured and compared to the amount at the beginning of the test. Lower lead and copper content in the oil indicates decreased lead and copper corrosion. Overall the results obtained for each lubricant are as follows:

TABLE 3

| Corrosion Bench Test | | |
|---|---|---|
| Example | Pb (ppm) 336 hr | Cu (ppm) 336 hr |
| EX1 | 101 | 153 |
| EX2 | 42 | 144 |
| EX3 | 54 | 115 |
| EX4 | 54 | 114 |
| EX5 | 45 | 84 |
| EX6 | 49 | 122 |
| EX7 | 51 | 96 |
| EX8 | 63 | 116 |
| EX9 | 52 | 18 |

The data presented indicates that the lubricating composition of the invention (for example, an internal combustion engine lubricant) containing inventive borate esters provided exceptional anti-corrosion performance (Cu/Pb) as well as improved compatibility with lubricating base oil. Surprisingly, borate esters with branched alcohols demonstrated stronger performance than their linear analogues with the same chain length.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

As used herein the term "hydrocarbylene" is used in a similar way as hydrocarbyl, except where the hydrocarbyl group has a carbon atom directly attached to the remainder of the molecule e.g., an alkyl group. In contrast, a hydrocarbylene group is attached to two atoms within the molecule e.g., an alkylene group (e.g., —$CH_2CH_2CH_2$—).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricant composition comprising:

an oil of lubricating viscosity; and a borate ester being the reaction product of boric acid and 2-propyl heptanol, said borate ester being present in an amount to provide about 100 to about 200 parts per million by weight of boron to the lubricant composition.

2. The lubricant of claim 1, further comprising an overbased detergent.

3. The lubricant of claim 1, further comprising at least one amine-functionalized dispersant having a total base number of 1 to 110 mg KOH/g.

4. The lubricant of claim 1, further comprising at least one amine-functionalized dispersant in an amount sufficient to deliver a TBN of 0.5 to 8 mg KOH/g to the lubricant.

5. A method for lubricating a mechanical device, comprising supplying thereto the lubricant of claim 1.

6. The method of claim 5, wherein the mechanical device is an internal combustion engine.

7. A method of reducing corrosion in an internal combustion engine comprising:

providing a lubricating composition comprising (a) an oil of lubricating viscosity, and (b) a borate ester being the reaction product of boric acid and 2-propyl heptanol, said borate ester being present in an amount to provide about 100 to about 200 parts per million by weight of boron to the lubricant composition; and supplying said lubricating composition to said internal combustion engine.

* * * * *